US006733009B2

(12) United States Patent
Ogasawara

(10) Patent No.: US 6,733,009 B2
(45) Date of Patent: May 11, 2004

(54) IMAGE FORMING APPARATUS

(75) Inventor: Seiji Ogasawara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/136,375

(22) Filed: May 2, 2002

(65) Prior Publication Data

US 2002/0175461 A1 Nov. 28, 2002

(30) Foreign Application Priority Data

May 10, 2001 (JP) ..... 2001-139977

(51) Int. Cl.[7] ..... B65H 7/02

(52) U.S. Cl. ..... 271/265.01; 318/685; 318/696

(58) Field of Search ..... 271/264, 265.01, 271/265.02, 272; 324/635, 644, 662, 699, 716; 310/68 B, 49; 318/696, 685, 138, 700

(56) References Cited

U.S. PATENT DOCUMENTS 4,661,882 A * 4/1987 Presley ..... 361/159
5,586,755 A * 12/1996 Hansen ..... 271/9.06
5,725,319 A 3/1998 Saito et al. ..... 400/629
5,739,661 A * 4/1998 Wakuda ..... 318/685
5,897,237 A * 4/1999 Kono ..... 399/18
5,899,613 A 5/1999 Koike et al. ..... 399/384
6,113,215 A * 9/2000 Yanagi et al. ..... 347/49
6,150,788 A * 11/2000 Someya ..... 318/685
6,208,107 B1 * 3/2001 Maske et al. ..... 318/685
6,402,133 B1 * 6/2002 Miyake ..... 271/3.19
6,462,503 B1 * 10/2002 Narazaki ..... 318/696

* cited by examiner

*Primary Examiner*—Donald P. Walsh
*Assistant Examiner*—Matthew J. Kohner
(74) *Attorney, Agent, or Firm*—Fitzpatrick, Cella, Harper & Scinto

(57) ABSTRACT

An image forming apparatus for forming an image on a recording medium with a recording head, comprising a conveying roller pair for conveying the recording medium, discharging roller pairs for conveying the recording medium in the downstream of the conveying roller pair, and a stepping motor for driving the conveying roller pair and the discharging roller pairs. A peak value of driving current of the stepping motor after a trailing edge of the recording medium passes the conveying roller pair is smaller than a peak value of driving current of the stepping motor before the tailing edge of the recording medium passes the conveying roller pair.

18 Claims, 8 Drawing Sheets

IMAGE FORMING APPARATUS

BACKGROUND OF THE INVENTION

1. Field of the Invention

The present invention relates to an image forming apparatus for forming an image on a sheet, which is a recording medium, for use in a printer, a copying machine, a facsimile machine, or the like, and particularly to an image forming apparatus for forming an image on a sheet by moving a recording head, which is image formation means, for scanning while conveying the sheet.

2. Related Background Art

In general, there is widely known an image forming apparatus comprising a recording medium separating and feeding means for separating and feeding a sheaf of sheets one by one, a recording medium conveying means for conveying the separated and fed sheet, an image forming means for forming an image on the sheet under conveyance, and a recording medium discharging means for discharging the sheet on which the image formation has been completed to an outside of the apparatus; it is used as a printer, a copying machine, or a facsimile machine, for example.

Referring to FIG. 4, there is shown a perspective diagram illustrating a structure of an ink-jet printer, given as an example of this type of image forming apparatus. Referring to FIG. 5, there is shown a cross section of the structure of the ink-jet printer. Referring to FIG. 6, there is shown a diagram illustrating a transmission configuration for conveying a sheet in the image forming apparatus.

As shown in FIG. 4 and FIG. 5, the ink-jet printer comprises a feeder 1 (i.e. a paper feeding apparatus), a platen 6, a stepping motor gear 7 (FIG. 5), a conveying roller 8, a sensor lever 9 (FIG. 5), a sheet sensor 10 (FIG. 5), a pinch roller spring 11 (FIG. 5), a pinch roller 12, a recording head 13 as image forming means, a stepping motor 14, a conveying roller gear 15, a carriage 16, a guide shaft 17, a guide rail 18 (FIG. 5), a carriage motor 19, a timing belt 20, discharging rollers 21, follower spurs 22, a frame 23 (FIG. 5), intermediate gears 24, and discharging roller gears 25.

The feeder 1, which is a recording medium separating and feeding means, comprises a plate 2, a feeder base 3, a feeding motor 4, a feeding roller 5, and a plate spring 27. The recording medium conveying means is a conveying roller pair comprising the conveying roller 8 and the pinch roller 12. The recording medium discharging means is a discharging roller pair comprising the discharging rollers 21 and the follower spurs 22. A recording medium detecting means comprises the sensor lever 9 and the sheet sensor 10. The frame 23 is used for mounting the above composing elements.

In addition, as shown in FIG. 6, the stepping motor gear 7 arranged at a rotary shaft of the stepping motor 14 is coupled to the conveying roller gear 15 arranged at the conveying roller 8, two intermediate gears 24, and two discharging roller gears arranged at the discharging rollers 21 in a sheet conveying direction. Therefore, the conveying roller 8 is driven by the stepping motor 14, which is a driving source, via the stepping motor gear 7 and the conveying roller gear 15. The discharging rollers 21 are driven by the stepping motor 14, which is a driving source, via the stepping motor gear 7, the conveying roller gear 15, the intermediate gears 24, and the discharging roller gears 25.

As shown in FIG. 5, the plate 2 is supported by the feeder base 3 in a condition that it can turn, and the plate 2 is stacked with a sheaf of sheets on its top surface. For sheet feeding, the feeding motor 4, which is a driving source, rotates the feeding roller 5 and the plate 2 turns toward the feeding roller 5 by means of the plate spring 24, and the sheaf of sheets are put in contact with the feeding roller 5 with pressure.

Furthermore, when the feeding roller 5 rotates, only the top sheet among the sheets is separated from the sheaf of the sheets and then fed to the downstream. The sheet separated and fed by the feeder 1 is fed to the conveying roller pair by a further rotation of the feeding roller 5. Then, a leading edge of the sheet pushes the sensor lever 9 arranged between the feeding roller 5 and the conveying roller 8 so as to turn the sensor lever 9. The sheet sensor 10 detects that the leading edge of the sheet has reached a given position from the sensor lever 9 turning and falling out of the inside of the sheet sensor 10 and detects that a trailing edge of the sheet has reached a given position from the sensor lever 9 entering into the sheet sensor 10 again.

If the sheet sensor 10 detects the leading edge of the sheet, the sheet is conveyed by a given amount by the feeding roller 5 and then abutted against a nip portion 26 between the conveying roller 8 and the pinch roller 12 urged to the conveying roller 8 by means of the pinch roller spring 11. When the feeding roller 5 further conveys the sheet by a given amount in this condition, the leading edge of the sheet is pushed to the nip portion 26 and the registration is completed.

After the completion of the registration, the sheet is conveyed to the top of the platen 6 by a rotation of the conveying roller 8 and supported by the top surface of the platen 6 at a position where the sheet is opposing to an arrangement surface of an ink discharge nozzle of the recording head 13.

Subsequently, ink drops are discharged from the recording head 13 mounted on the carriage 16 for scanning the sheet supported by the top surface of the platen, by which an image is formed on the sheet. The carriage 16 is supported by the guide shaft 17 and the guide rail 18 in a condition that scanning is possible and is driven by the carriage motor 19 via the timing belt 20.

The sheet on which the image formation has completed is discharged to an outside of the apparatus by rotations of the discharging rollers 21 and the follower spurs 22 urged to the discharging rollers 21 by means of spur springs (not shown).

The following summarizes a flow of conveying a sheet in the ink-jet printer with reference to FIG. 7. As shown in FIG. 7, the sheet fed by the feeding roller 5 is conveyed by a rotation of the conveying roller pair comprising the conveying roller 8 and the pinch roller 12, which is its follower roller, to a position where an image is formed by the recording head 13. Then, the image is formed on the sheet through a repetition of scanning with the carriage 16 having the recording head 13 and sheet conveyance with the conveying roller pair.

The sheet on which the image formation has completed is discharged to the outside of the image forming apparatus by two discharging roller pairs comprising the discharging rollers 21 and their follower rollers, the follower spurs 22. As described above, the sheet sensor 10 detects that the leading edge or the trailing edge of the sheet has reached the given position and the stepping motor 14 drives both of the conveying roller pair and the discharging roller pairs.

Conventionally, the image forming apparatus considers a load on the stepping motor 14 or torque characteristics before applying a sine-curved driving current having a fixed peak value as shown in FIG. 8 or a rectangular-waveform driving current to the stepping motor 14 so as to control the rotation of the stepping motor 14.

This type of image forming apparatuses include one having a configuration in which the image formation is further continued after the trailing edge of the sheet passes the conveying roller pair. In this image forming apparatus, a sheet conveying state changes from a conveying state with the conveying roller pair or with both of the conveying roller pair and the discharging roller pairs (hereinafter, referred to as a conveying state with the conveying roller pair) to a conveying state with the discharging roller pairs only in the middle of the image formation.

In this image forming apparatus, generally the urging force of the pinch roller 12 at the conveying roller pair is greater than the urging force of the follower spurs 22 at the discharging roller pairs and therefore the load on the stepping motor 14 in the conveying state with the conveying roller pair is greater than that in the conveying state with the discharging roller pairs only. Even if, however, the load on the stepping motor 14 becomes smaller in the conveying state with the discharging roller pairs only, the peak value of the driving current applied to the stepping motor 14 remains at the fixed level. This causes a problem that the stepping motor 14 has excessive torque, thereby generating larger driving noise of the stepping motor 14 or a problem that an overshoot rises at a stop of the stepping motor 14, thereby deteriorating a sheet conveying accuracy.

On the other hand, it is known in this image forming apparatus that the overshoot at the stop of the stepping motor 14 drops by continuously applying phase-excitation, namely, a fixed amount of electric current to the stepping motor 14 to retain its stop phase when the stepping motor 14 is stopped during the image formation, by which the stopping accuracy of the stepping motor 14 is improved.

If, however, a fixed amount of electric current is continuously applied to the stepping motor 14 to retain its stop phase when the stepping motor 14 is stopped during the image formation, there is a problem that the stepping motor 14 generates large stop noise at the moment the stepping motor 14 stops.

An experiment proved that this noise in the conveying state with the conveying roller pair is larger than the noise in the conveying state with the discharging roller pairs only. As described above, the load on the stepping motor 14 in the conveying state with the discharging roller pairs only is smaller than in the conveying state with the conveying roller pair and therefore there is a large effect of retaining the stop phase by applying a fixed amount of electric current. In the conveying state with the conveying roller pair, however, a large load is applied on the stepping motor 14 and therefore the overshoot at the stop of the stepping motor 14 is low without retaining the stop phase by applying a fixed amount of electric current, by which an experiment proved that a sufficient conveying accuracy is ensured.

As set forth in the above, the conventional image forming apparatus has the following problems:

(1) The load on the stepping motor is large in the conveying state with the conveying roller pair in comparison with the load in the conveying state with the discharging roller pairs only. Even if the load on the stepping motor drops in the conveying state with the discharging roller pairs only, however, the peak value of the electric current applied to the stepping motor remains at the fixed level. This causes problems that the stepping motor has redundant torque, thereby causing large driving noise of the stepping motor or that an overshoot amount rises at the stop of the stepping motor, thereby deteriorating the conveying accuracy of the sheet.

(2) When the stepping motor is stopped during the image formation, a fixed amount of electric current is continuously applied to the stepping motor to retain its stop phase, which decreases an overshoot amount at the stop of the stepping motor and improves the stopping accuracy of the stepping motor. If this method is used, however, there is a problem that the stepping motor generates large stop noise.

SUMMARY OF THE INVENTION

Therefore it is an object of the present invention to provide an image forming apparatus which can prevent deterioration of a stopping accuracy caused by an overshoot at a stop of a stepping motor and can reduce noise generated by the stepping motor.

It is another object of the present invention to provide an image forming apparatus for forming an image on a recording medium with a recording head, comprising a conveying roller pair for conveying the recording medium, discharging roller pairs for conveying the recording medium in the downstream of the conveying roller pair, and a stepping motor for driving the conveying roller pair and the discharging roller pairs, wherein a peak value of driving current of the stepping motor after a trailing edge of the recording medium passes the conveying roller pair is smaller than a peak value of driving current of the stepping motor before the trailing edge of the recording medium passes the conveying roller pair.

It is still another object of the present invention to provide an image forming apparatus for forming an image on a recording medium with a recording head, comprising a conveying roller pair for conveying the recording medium, discharging roller pairs for conveying the recording medium in the downstream of the conveying roller pair, and a stepping motor for driving the conveying roller pair and the discharging roller pairs, wherein phase-excitation of the stepping motor is conducted before a trailing edge of the recording medium reaches the conveying roller pair and the phase-excitation of the stepping motor is halted after the trailing edge of the recording medium passes the conveying roller pair.

It is a further object of the present invention to provide an image forming apparatus for forming an image on a recording medium with a recording head, comprising a conveying roller pair for conveying the recording medium, discharging roller pairs for conveying the recording medium in the downstream of the conveying roller pair, and a stepping motor for driving the conveying roller pair and the discharging roller pairs, wherein a peak value of driving current of the stepping motor after a trailing edge of the recording medium passes the conveying roller pair is smaller than a peak value of driving current of the stepping motor before the trailing edge of the recording medium passes the conveying roller pair and wherein phase-excitation of the stepping motor is performed before the trailing edge of the recording medium passes the conveying roller pair and the phase-excitation of the stepping motor is halted after the trailing edge of the recording medium passes the conveying roller pair.

DETAILED DESCRIPTION OF THE PREFERRED EMBODIMENTS

The preferred embodiments of the present invention will now be described in detail hereinafter with reference to the accompanying drawings.

First Embodiment

An image forming apparatus according to a first embodiment of the present invention is described, first. The image forming apparatus according to this embodiment has the same configuration as of a conventional image forming apparatus. The image forming apparatus according to this embodiment, however, differs from the conventional image forming apparatus in a driving current control method of a stepping motor 14.

Figure 1:
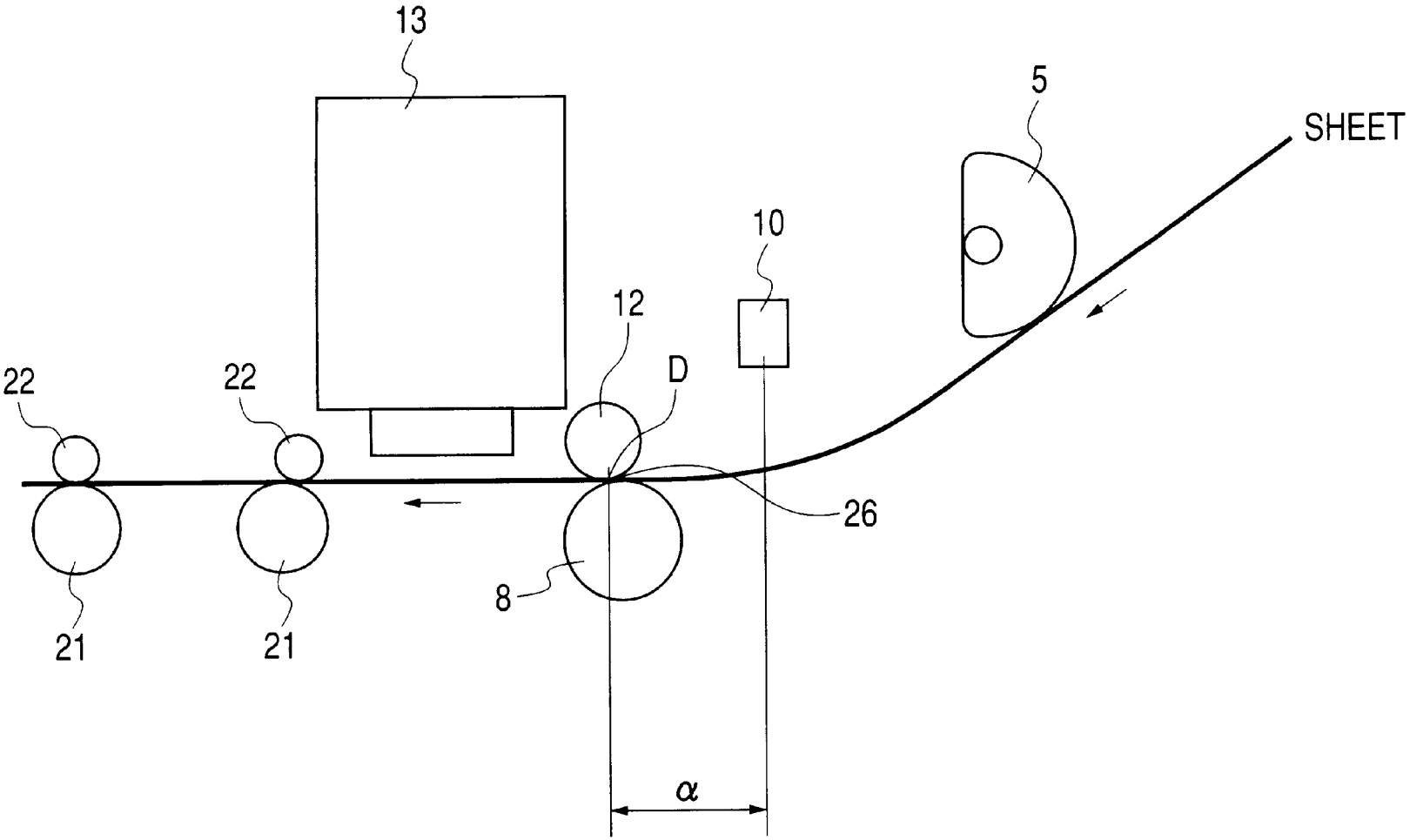
FIG. 1 is a diagram showing a flow of conveying a sheet in an image forming apparatus according to a first embodiment of the present invention.
Figure 2:
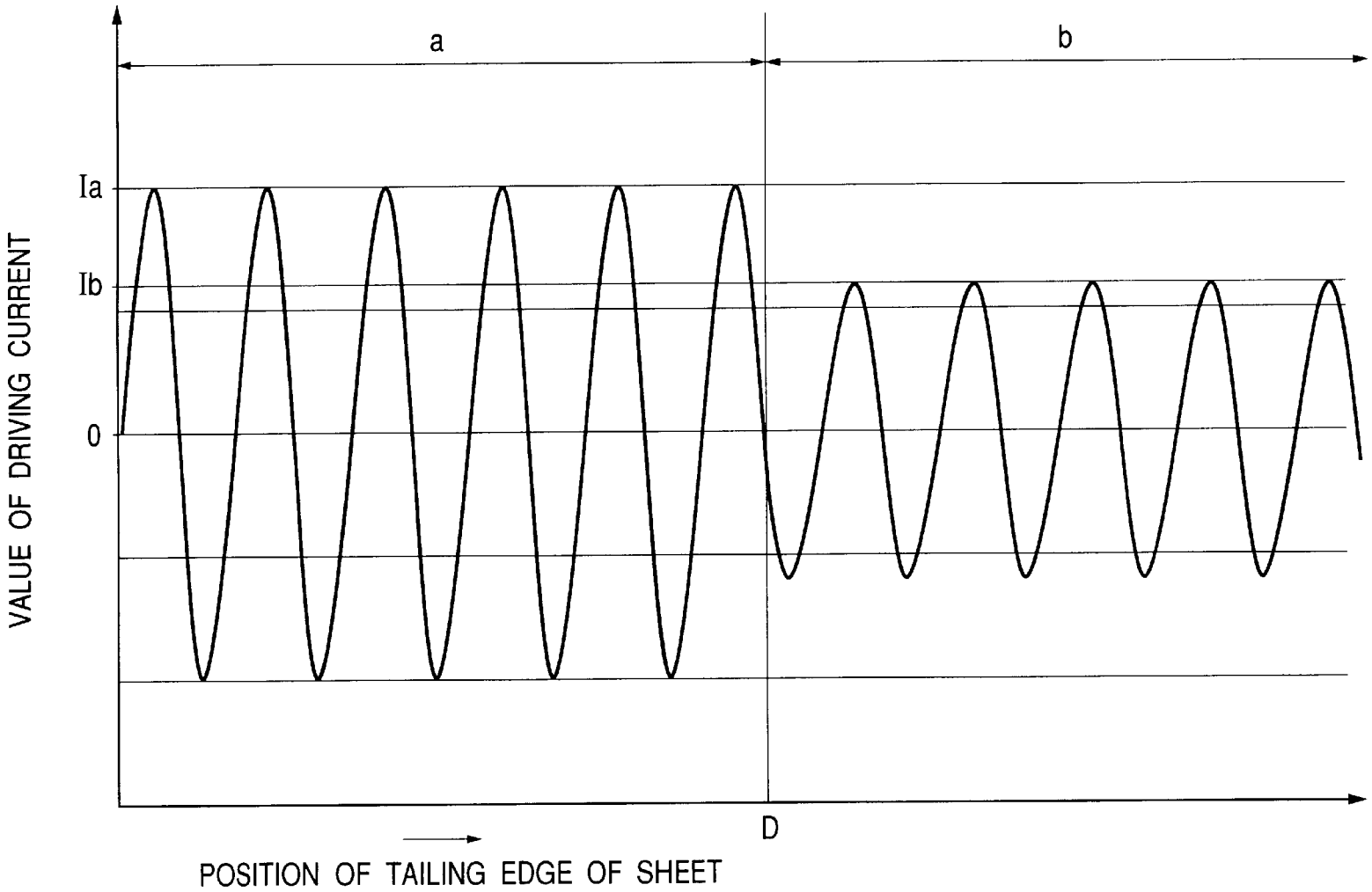
FIG. 2 is a graph showing changes of electric current applied to the stepping motor in the image forming apparatus according to the first embodiment of the present invention.

Referring to FIG. 1, there is shown a diagram illustrating a flow of conveying a sheet in the image forming apparatus according to this embodiment. Referring to FIG. 2, there is shown a graph illustrating changes of electric current applied to the stepping motor 14 in the image forming apparatus according to this embodiment.

As shown in FIG. 1, a position D is assumed to be a position of a nip portion 26 of a conveying roller pair comprising a conveying roller 8 and a pinch roller 12. As shown in FIG. 2, according to the image forming apparatus of this embodiment, the stepping motor 14, which is a driving source of the conveying roller 8, is driven by using electric current having a peak value Ia until just before a trailing edge of a sheet passes the position D (period a) during an image formation on the sheet.

Furthermore, according to the image forming apparatus of this embodiment, the stepping motor 14 is driven by using electric current having a peak value Ib smaller than Ia in a conveying state with discharging roller pairs only during a period from the moment that the trailing edge of the sheet has passed the nip portion 26 during the image formation to the moment that the sheet is discharged by discharging rollers 21 (period b). The peak value Ib of the current has only to be a value necessary for conveying the sheet by the discharging roller pairs. Additionally, as shown in FIG. 1, whether the trailing edge of the sheet has passed the nip portion 26 is determined according to whether the sheet has been conveyed by a distance $\alpha$ between a detecting position of the trailing edge of the sheet with a sheet sensor 10 and the nip portion 26 with focused on the trailing edge of the sheet.

As set forth hereinabove, according to the image forming apparatus of this embodiment, the peak value Ib of driving current of the stepping motor 14 after the trailing edge of the sheet during image formation has passed through the nip portion 26 of the conveying roller pair comprising the conveying roller 8 and the pinch roller 12 is set to a smaller value than the peak value Ia of the driving current until just before the trailing edge of the sheet passes through the nip portion 26, by which it becomes possible to eliminate redundant driving torque of the stepping motor 14 in the conveying state with the discharging roller pairs only. Therefore, the image forming apparatus according to this embodiment not only prevents the stopping accuracy from being deteriorated by an overshoot at the stop of the stepping motor 14 and enables a reduction of noise generated by the stepping motor 14, but also achieves power saving.

Second Embodiment

An image forming apparatus according to a second embodiment of the present invention will be described, next. The image forming apparatus of this embodiment has the same configuration as of the image forming apparatus of the first embodiment. The image forming apparatus of this embodiment differs from that of the first embodiment in controlling the retention of a stop phase of the stepping motor 14.

Figure 3:
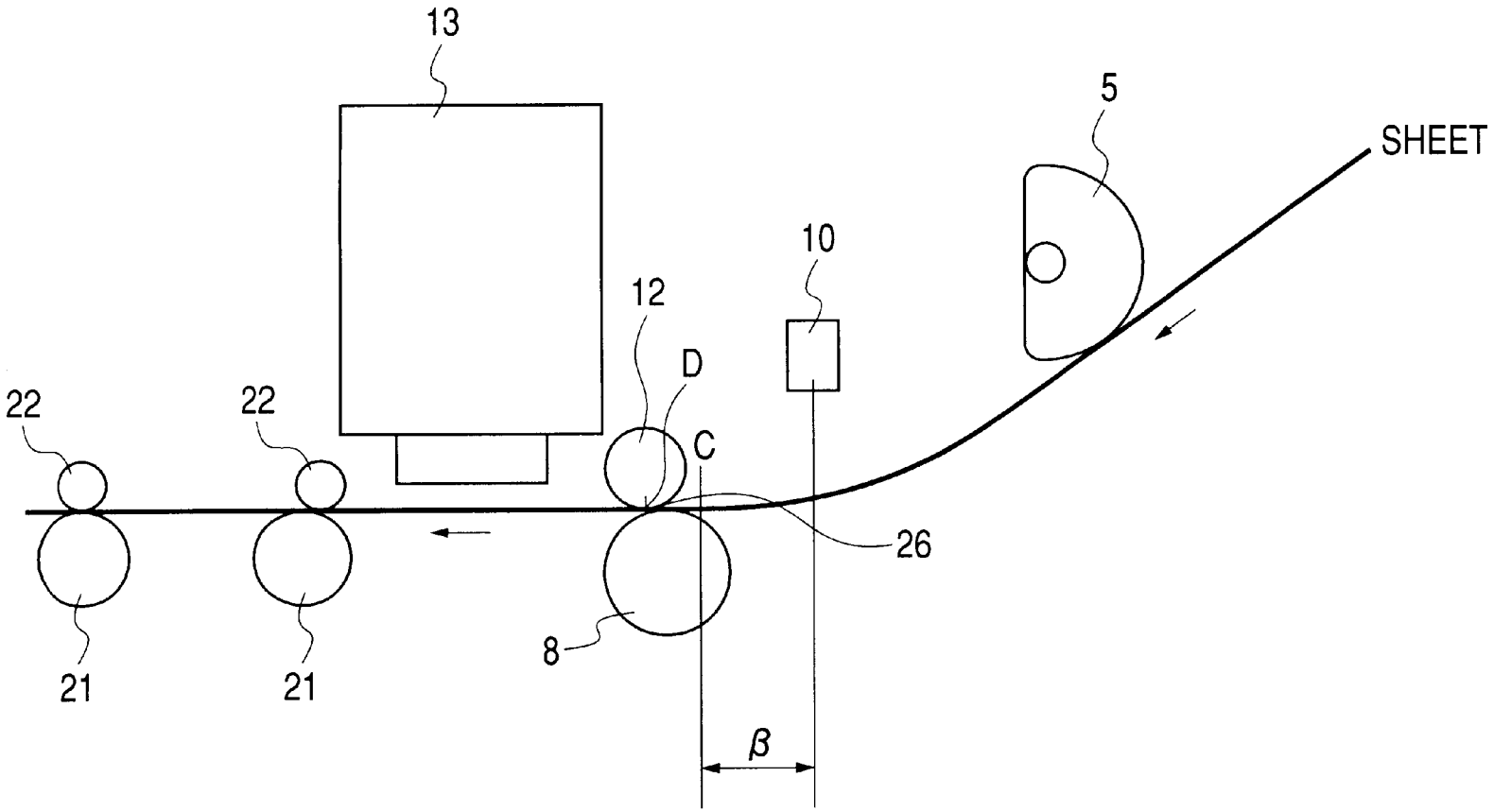
FIG. 3 is a diagram showing a flow of conveying a sheet in an image forming apparatus according to a second embodiment of the present invention.
Figure 4:
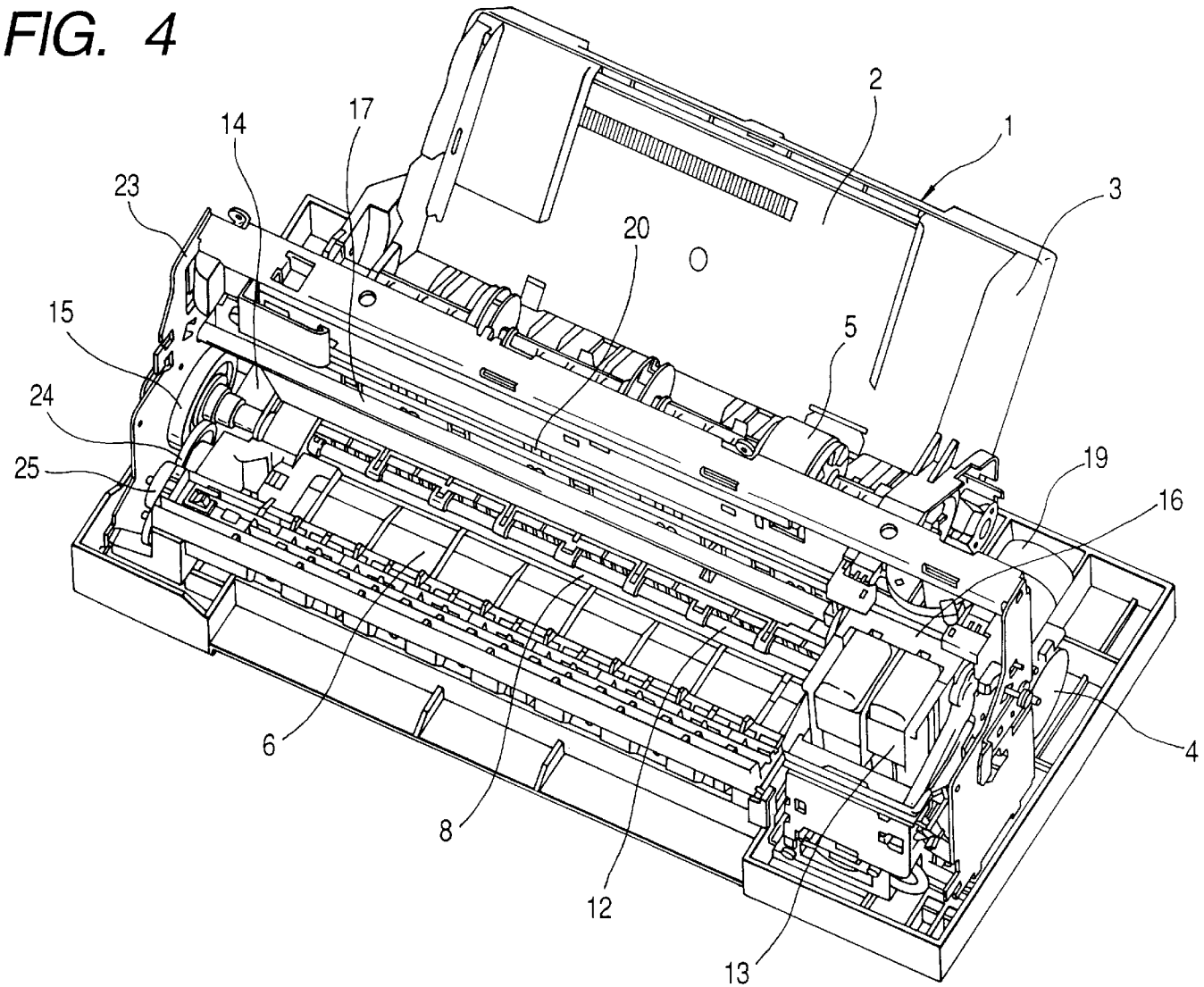
FIG. 4 is a perspective view showing a structure of an ink-jet printer as an example of the image forming apparatus.
Figure 5:
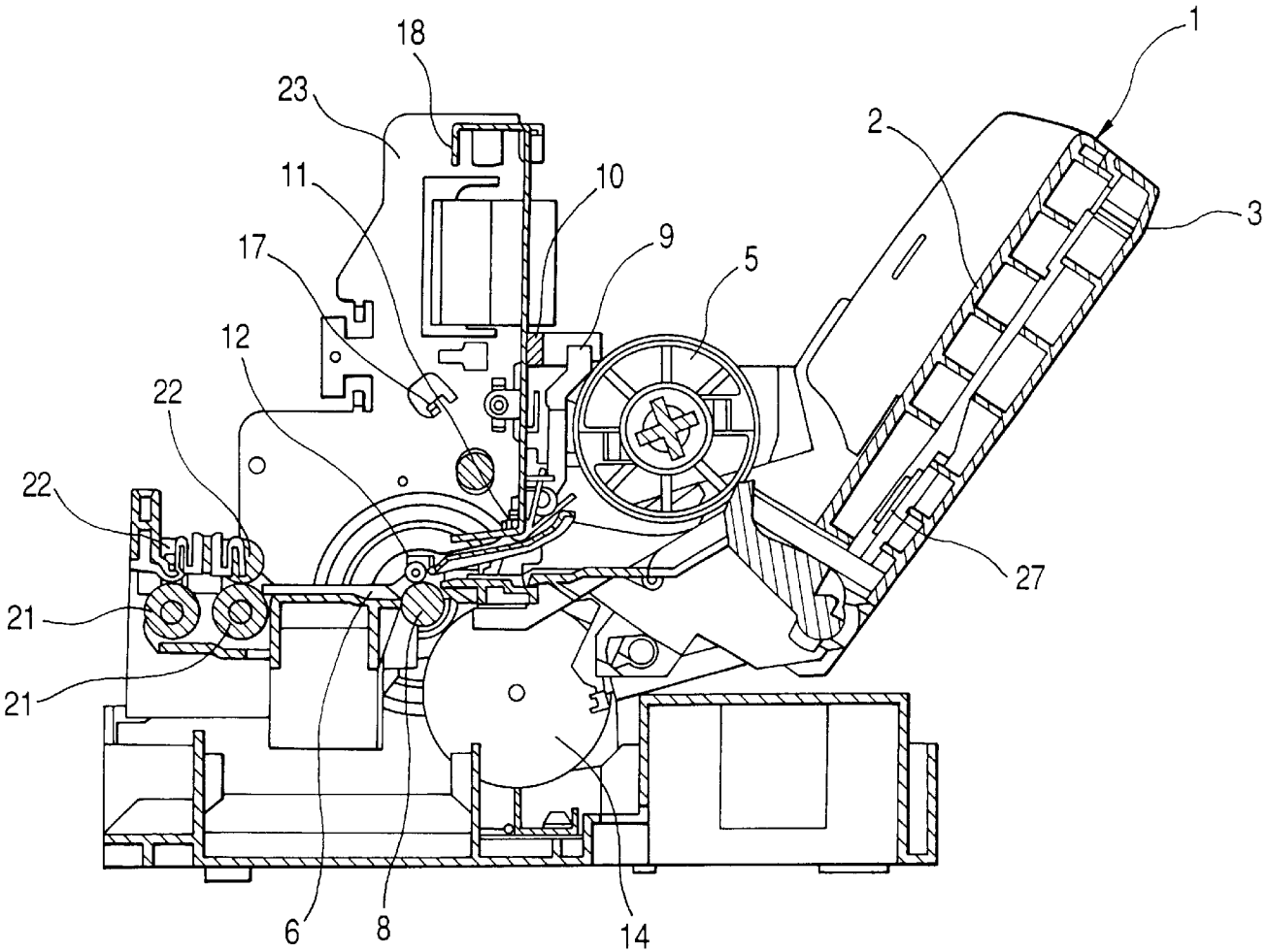
FIG. 5 is a cross section showing a structure of the ink-jet printer.
Figure 6:
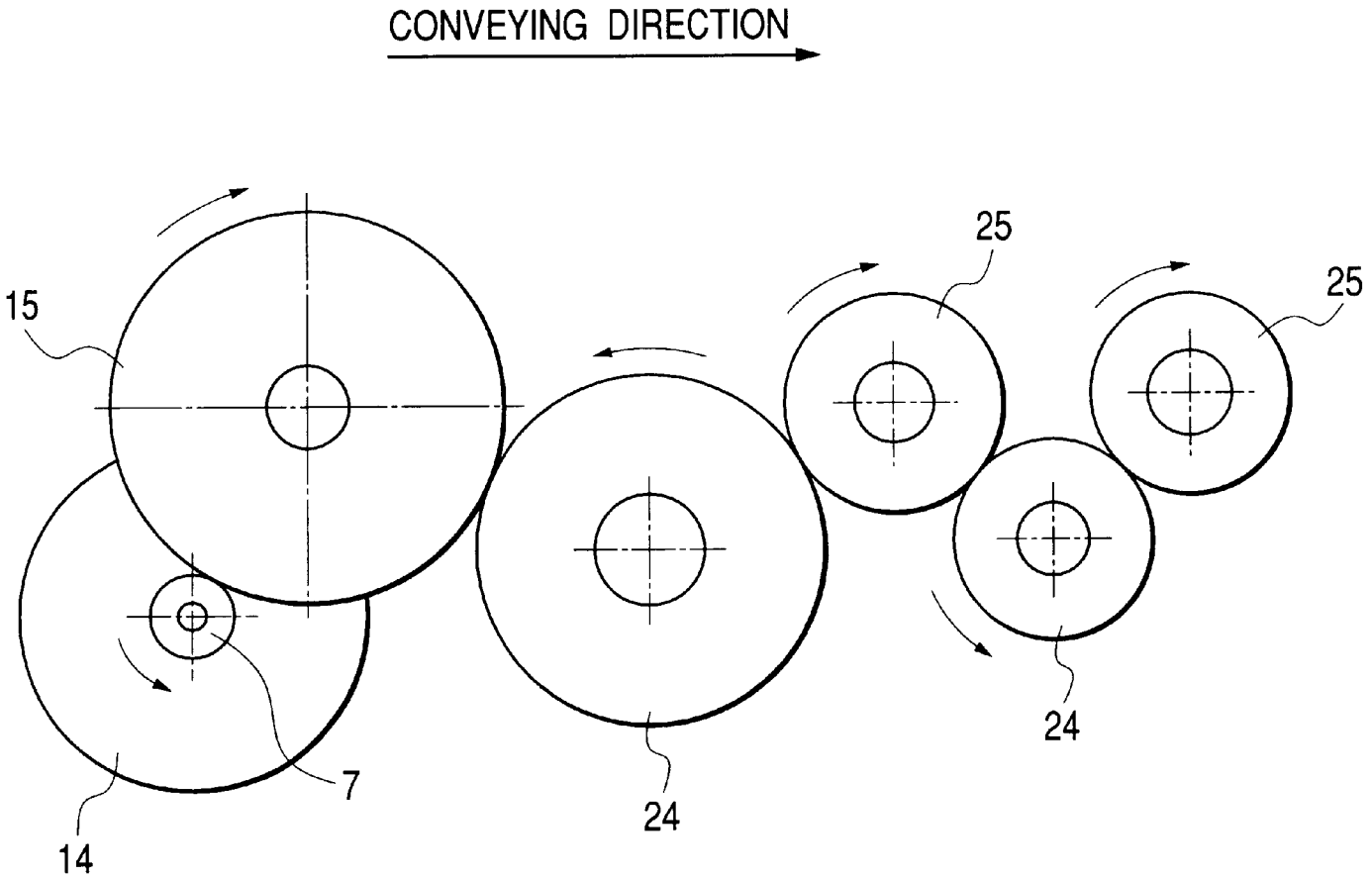
FIG. 6 is a diagram showing a transmission configuration for conveying a sheet in the image forming apparatus.
Figure 7:
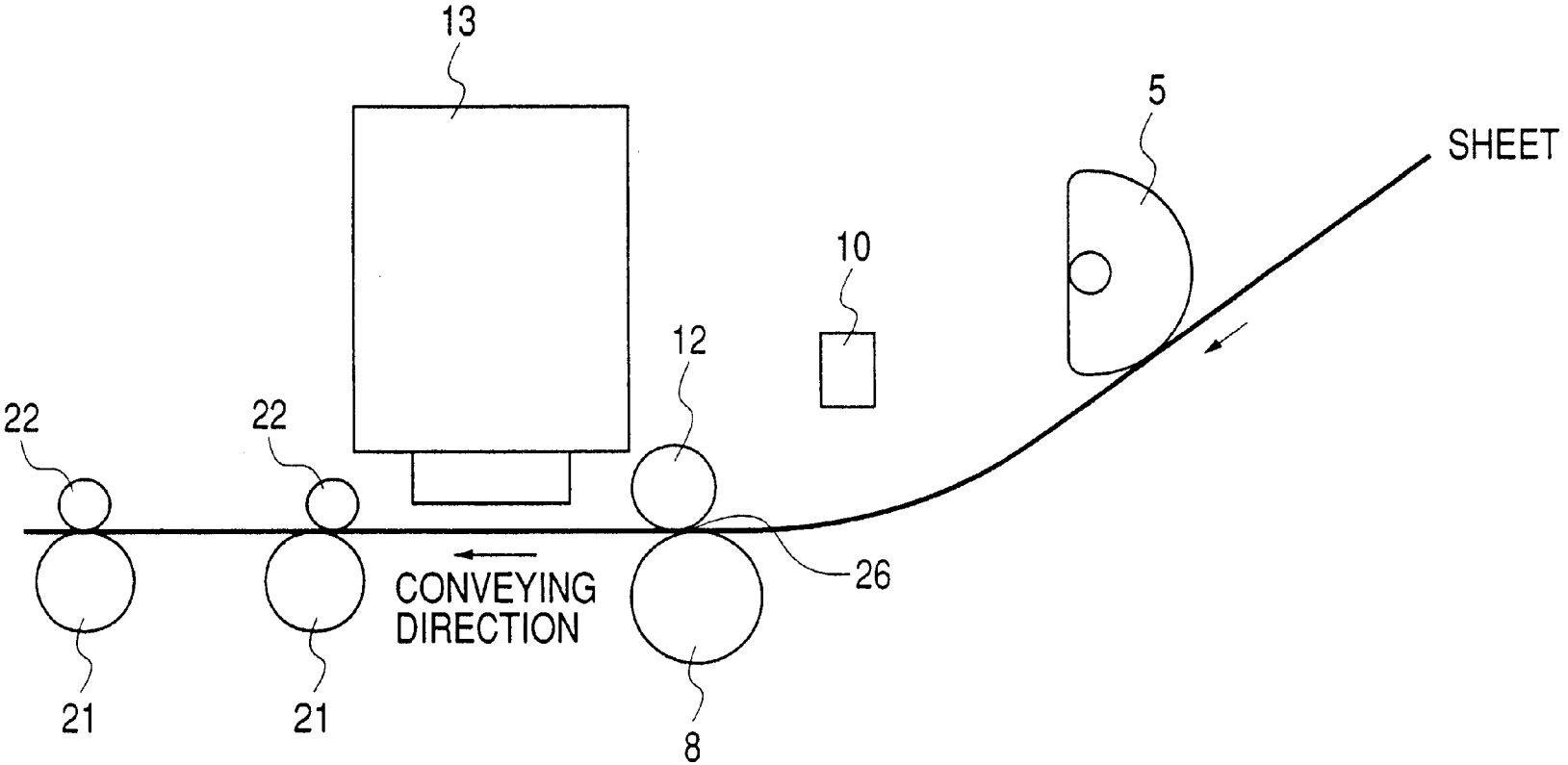
FIG. 7 PRIOR ART
FIG. 7 is a diagram showing a flow of conveying a sheet in a conventional image forming apparatus.
Figure 8:
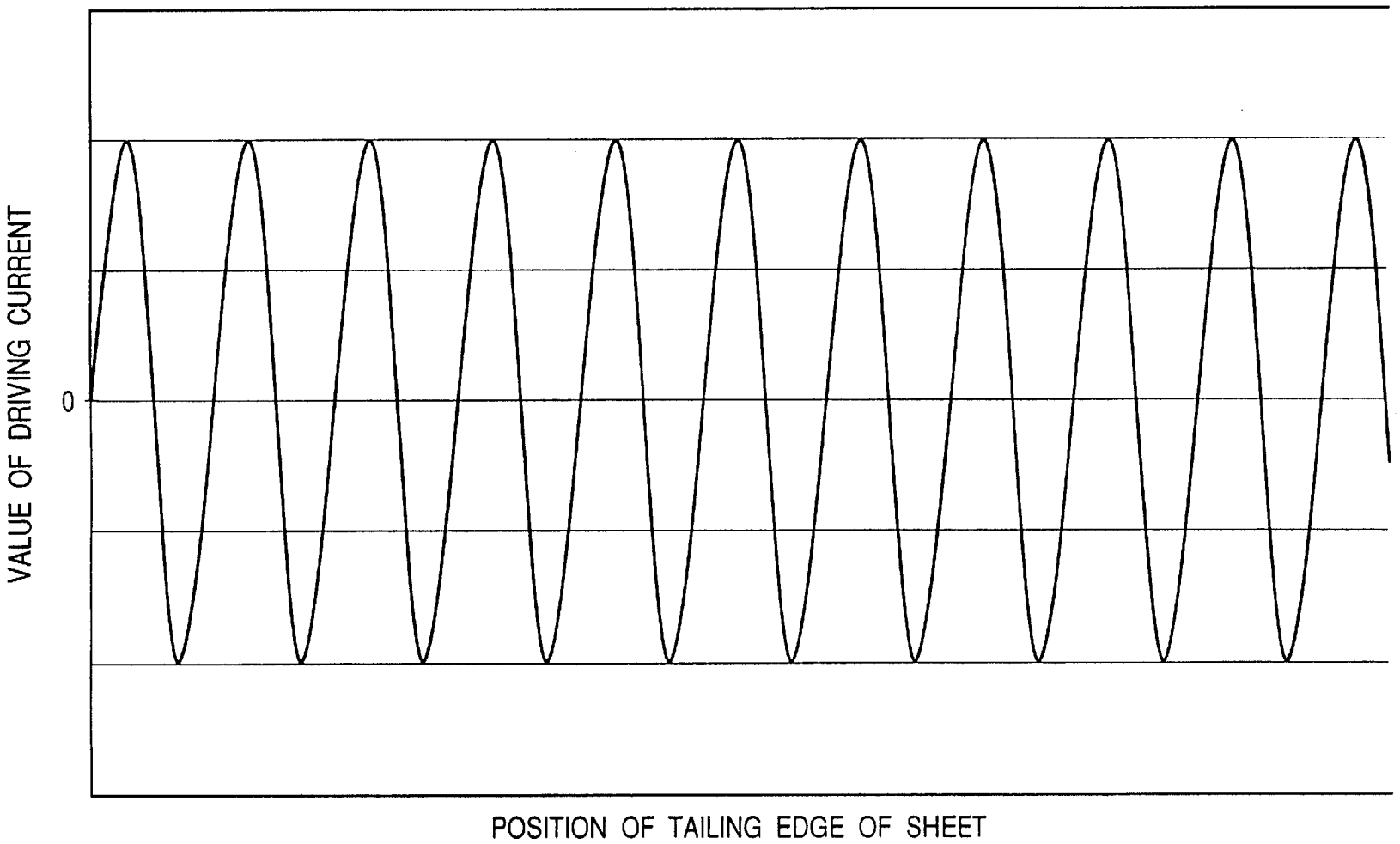
FIG. 8 PRIOR ART
FIG. 8 is a diagram showing changes of electric current applied to a stepping motor in the conventional image forming apparatus.

Referring to FIG. 3, there is shown a diagram illustrating a flow of conveying a sheet in the image forming apparatus of this embodiment. As shown in FIG. 3, a position C is assumed to be a position located just before the nip portion 26 of a conveying roller pair comprising the conveying roller 8 and the pinch roller 12. According to the image forming apparatus of this embodiment, the phase-excitation for retaining a stop phase of the stepping motor 14 is not performed at a stop of the stepping motor 14, which is a driving source of the conveying roller 8, before a trailing edge of the sheet passes the position C during image formation on the sheet. In other words, the apparatus does not perform a control of retaining the stop phase with applying a fixed amount of electric current. Whether the trailing edge of the sheet has passed the position C is determined according to whether the sheet has been conveyed by a distance b between a detecting position of the trailing edge of the sheet with a sheet sensor 10 and the nip portion 26 with focused on the trailing edge of the sheet, as shown in FIG. 3.

During a period up to the moment that the trailing edge of the sheet passes the position C, a load on the stepping motor 14 is greater than one after the trailing edge of the sheet has passed through the nip portion 26 and therefor the overshoot has already been sufficiently low at the stop of the stepping motor 14. Therefore, in this interval, there is no problem on the conveying accuracy without the control of retaining the stop phase for exciting and retaining the stop phase of the stepping motor 14.

In the image forming apparatus of this embodiment, during a period from the moment that the trailing edge of the sheet passes the position C during image formation to the moment that the sheet is discharged by the discharging rollers 21, in other words, at the moment the trailing edge of the sheet passes the nip portion 26 and in the conveying state with the discharging roller pairs only, the phase-excitation is conducted to retain the stop phase of the stepping motor 14 at the stop of the stepping motor 14. In other words, the apparatus controls the retention of the stop phase with continuously applying a fixed amount of electric current.

In the image forming apparatus of tins embodiment, electric current for retaining the stop phase is applied at the stop of the stepping motor 14 from just before the trailing edge of the sheet passes through the nip portion 26 of the conveying roller pair comprising the conveying roller 8 and the pinch roller 12 during the image formation, by which it becomes possible to prevent the deterioration of the stopping accuracy caused by an overshoot at the stop of the motor at the moment the trailing edge of the sheet passes the nip portion 26 and in the state of conveying the sheet with the discharging roller pairs only.

As set forth hereinabove, according to the image forming apparatus of this embodiment, a fixed amount of current for retaining the stop phase of the stepping motor 14 is not applied to the stepping motor 14 until just before the trailing edge of the sheet passes the nip portion 26, thereby not only enabling a reduction of stop noise generated by the stepping motor 14 in the conveying state with the conveying roller pair, but also achieving power saving.

Preferably the control of retaining the stop phase in the image forming apparatus of this embodiment is conducted only for a multi-path image formation on special paper particularly requiring a sheet conveyance at a high conveying accuracy. In other words, when an image is formed on plain paper with a single path, the control of retaining the stop phase is not performed in the image formation even after the trailing edge of the sheet passes through the nip portion 26 of the conveying roller pair. This enables further power saving.

Naturally, by further conducting the driving current control of the stepping motor 14 described in the first embodiment in the image forming apparatus of the second embodiment, effects of the high accuracy, the low noise, and the power saving are further enhanced.

Furthermore, while the image forming apparatus according to the first or second embodiment is applied to an ink-jet printer as an example of the image forming apparatus, the image forming apparatus of the present invention is not limited to this, but it is also applicable to a copying machine, a facsimile, or the like.

Each of the above embodiments has a configuration in which the present invention is applied to a serial type recording apparatus with a recording head moving in the horizontal scanning direction. The present invention, however, is also applicable to a full-line type recording apparatus with a recording head extending over the cross direction entire area of a recording sheet while continuously conveying the recording sheet for image recording.

In addition, the above embodiments have been described by giving an example having a bubble-jet recording head in the ink-jet prints. The present invention, however, is not limited to the recording method of this recording head, but is applicable to various recording methods. As a recording method of the recording head, a piezo electric type of print, for example, can be used in addition to the bubble-jet print.

As set forth hereinabove, according to the embodiments the present invention has the following effects:

(1) By setting a smaller peak value of the driving current of the stepping motor after the trailing edge of the sheet during image formation has passed through the nip portion of the conveying roller pair comprising the conveying roller and the pinch roller in comparison with a peak value of the driving current until just before the trailing edge of the sheet passes through the nip portion, redundant driving torque of the stepping motor can be eliminated in the conveying state with the discharging roller pairs only. Therefore, it is possible to prevent deterioration of the stopping accuracy caused by an overshoot at the stop of the stepping motor, to enable a reduction of noise generated by the stepping motor, and to achieve power saving.

(2) By inhibiting a control of retaining a stop phase until just before the trailing edge of the sheet during image formation passes through the nip portion of the conveying roller pair comprising the conveying roller and the pinch roller, excessive electric current is not applied to the stepping motor. Therefore, it is possible to reduce stop noise generated by the stepping motor and to achieve power saving.

What is claimed is:

1. An image forming apparatus for forming an image on a recording medium with a recording head, comprising:

a convey roller and a pinch roller for conveying a recording medium;

a discharging roller and a follower roller for conveying the recording medium in a downstream direction from said convey roller; and a stepping motor for driving said convey roller and said discharging roller pairs;

wherein a peak value of driving current of the stepping motor is controllable and the driving current of said stepping motor is controlled so that the peak value of the driving current after a trailing edge of the recording medium passes said convey roller is smaller than that before the trailing edge of the recording medium passes said convey roller.

2. The apparatus according to claim 1, further comprising detecting means for detecting the tailing edge of the recording medium.

3. The apparatus according to claim 1, wherein said recording head is an ink-jet recording head capable of discharging ink.

4. The apparatus according to claim 3, wherein said ink-jet recording head has an electrothermal converting member for generating thermal energy used for discharging ink.

5. An image forming apparatus for forming an image on a recording medium with a recording head, comprising:

a convey roller and a pinch roller for conveying the recording medium;

a discharging roller and a follower roller for conveying the recording medium in a downstream direction from said convey roller; and a stepping motor for driving said convey roller and said discharging roller, wherein a current for retaining a stop state of said stepping motor is controlled so that it is not applied when said stepping motor is stopped with the recording medium being nipped between said convey roller and said pinch roller, while it is applied when said stepping motor is stopped after a trailing edge of the recording medium passes said convey roller.

6. The apparatus according to claim 5, further comprising detecting means for detecting the tailing edge of the recording medium.

7. The apparatus according to claim 5, wherein the current of said stepping motor is not applied even before the tailing edge of the recording medium reaches said convey roller unless multi-path recording is conducted on the recording medium.

8. The apparatus according to claim 5, wherein it is determined whether the current should be applied according to a type of the recording medium.

9. The apparatus according to claim 5, wherein said recording head is an ink-jet recording head capable of discharging ink.

10. The apparatus according to claim 9, wherein said ink-jet recording head has an electrothermal converting member for generating thermal energy used for discharging ink.

11. An image forming apparatus for forming an image on a recording medium with a recording head, comprising:

a convey roller and a pinch roller for conveying the recording medium;

a discharging roller and a follower roller for conveying the recording medium in a downstream direction from said convey roller; and a stepping motor for driving said convey roller and said discharging roller, wherein a peak value of driving current of said stepping motor is controllable and the driving current of said stepping motor is controlled so that the peak value of the driving current after a trailing edge of the recording medium passes said convey roller is smaller than a peak value of driving current of said stepping motor before the trailing edge of the recording medium passes said convey roller, and wherein a current for retaining a stop state of said stepping motor is controlled so that it is not applied when said stepping motor is stopped with the recording medium being nipped between said convey roller and said pinch roller, while it is applied when said stepping motor is stopped after a trailing edge of the recording medium passes said convey roller.

12. The apparatus according to claim 11, further comprising detecting means for detecting the tailing edge of the recording medium.

13. The apparatus according to claim 12, wherein the application of current is not performed even before the tailing edge of the recording medium reaches said conveying roller pair unless multi-path recording is conducted on the recording medium.

14. The apparatus according to claim 11, wherein it is determined whether the application of current should be performed according to a type of the recording medium.

15. The apparatus according to claim 11, wherein said recording head is an ink-jet recording head capable of discharging ink.

16. The apparatus according to claim 15, wherein said ink-jet recording head has an electrothermal for converting member generating thermal energy used for discharging ink.

17. An image forming apparatus for forming an image on a recording medium with a recording head, comprising:

recording medium separating and feeding means for separating and feeding recording mediums one by one;

convey roller and a follower roller for conveying the recording medium separated and fed by said recording medium separating and feeding means;

a discharging roller and a follower roller for conveying the recording medium in a downstream direction from said convey roller;

a stepping motor for driving said convey roller and said discharging roller;

recording medium detecting means for detecting a trailing edge of the recording medium at a predetermined position in the upstream side of said convey roller; and image forming means disposed between said convey roller and said discharging roller, for forming an image on the recording medium conveyed by at least one of said convey roller and said discharging roller;

wherein a peak value of driving current of said stepping motor is controllable, and the driving current of said stepping motor is controlled so that the peak value of the driving current is reduced after a trailing edge of the recording medium is detected by said recording medium detecting means.

18. An image forming apparatus for forming an image on a recording medium with a recording head, comprising:

recording medium separating and feeding means for separating and feeding recording mediums one by one;

a convey roller and a first follower roller for conveying the recording medium separated and fed by said recording medium separating and feeding means;

a discharging roller and a second follower rollers for conveying the recording medium in a direction downstream of said convey roller;

a stepping motor for driving said convey roller and said discharging roller;

recording medium detecting means for detecting a trailing edge of the recording medium at a predetermined position in the upstream side of said convey roller; and image forming means disposed between said convey roller and said discharging roller, for forming an image on the recording medium conveyed by at least one of said convey roller and said discharging roller, wherein a current for retaining a stop state of said stepping motor is controlled so that it is not applied when said stepping motor is stopped with the recording medium being nipped between said convey roller and the follower roller, while it is applied when said stepping motor is stopped after a trailing edge of the recording medium is detected by said recording medium detecting means.

* * * * *

UNITED STATES PATENT AND TRADEMARK OFFICE

CERTIFICATE OF CORRECTION

PATENT NO. : 6,733,009 B2
DATED : May 11, 2004
INVENTOR(S) : Seiji Ogasawara

It is certified that error appears in the above-identified patent and that said Letters Patent is hereby corrected as shown below:

Column 5,
Line 65, "focused" should read -- focus --.

Column 6,
Line 43, "b" should read -- β --.

Column 7,
Line 1, "tins" should read -- this --.

Column 8,
Line 22, 'roller pairs;" should read -- roller; --.
Lines 31, 58, and 61, "tailing" should read -- trailing --.

Column 9,
Line 32, "tailing" should read -- trailing --.

Column 10,
Line 30, "rollers" should read -- roller --.

Signed and Sealed this

Twenty-fourth Day of August, 2004

JON W. DUDAS
*Director of the United States Patent and Trademark Office*